US009702324B2

(12) United States Patent
Dominic

(10) Patent No.: US 9,702,324 B2
(45) Date of Patent: Jul. 11, 2017

(54) PROTECTION OF VEHICLE ENGINE INTAKE COMPONENTS

(71) Applicant: Toyota Motor Engineering & Manufacturing North America, Inc., Erlanger, KY (US)

(72) Inventor: Justin E. Dominic, Milan, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 112 days.

(21) Appl. No.: 14/719,448

(22) Filed: May 22, 2015

(65) Prior Publication Data

US 2016/0341160 A1 Nov. 24, 2016

(51) Int. Cl.

| | |
|---|---|
| ***F02M 35/10*** | (2006.01) |
| ***F02M 35/104*** | (2006.01) |
| ***F02F 1/42*** | (2006.01) |

(52) U.S. Cl.

CPC ..... *F02M 35/1034* (2013.01); *F02F 1/4235* (2013.01); *F02M 35/104* (2013.01); *F02M 35/10144* (2013.01); *F02M 35/10216* (2013.01)

(58) Field of Classification Search

CPC ..... F02M 35/1034; F02M 35/10144; F02M 35/104; F02M 35/10216; F02M 35/116; F02F 1/4235; F02B 75/22; F02B 2075/1824

USPC ..... 123/195 A, 184.31

See application file for complete search history.

(56) References Cited

U.S. PATENT DOCUMENTS

| | | | | |
|---|---|---|---|---|
| 5,012,770 | A * | 5/1991 | Okamoto | F02M 35/10032 123/184.42 |
| 5,887,560 | A * | 3/1999 | Kobayashi | F02F 7/006 123/184.21 |
| 5,954,021 | A | 9/1999 | Yuunaga | |
| 6,142,114 | A | 11/2000 | Yoshikawa | |
| 6,289,863 | B1 * | 9/2001 | Hada | F02M 35/10052 123/184.47 |
| 6,553,955 | B1 * | 4/2003 | Hada | F02M 35/10124 123/184.42 |
| 7,104,256 | B2 * | 9/2006 | Shin | F02D 9/1035 123/184.25 |

(Continued)

FOREIGN PATENT DOCUMENTS

JP 2006342747 A 6/2005

OTHER PUBLICATIONS

Dominic; "Protection of Vehicle Engine Intake Components"; U.S. Appl. No. 14/719,456, filed May 22, 2015.

*Primary Examiner* — Hai Huynh

(74) *Attorney, Agent, or Firm* — Christopher G. Darrow; Darrow Mustafa PC

(57) ABSTRACT

Vehicle engine systems and load path brackets for such systems are presented. The load path brackets can be positioned between an air intake system and a cylinder bank of an engine. In some embodiments, the load path brackets can be operatively connected to a surge tank at a first end and to a cylinder head cover at a second end. The load path brackets can be constructed, positioned, and/or oriented to absorb or transfer forces acting upon the engine system during impacts. For instance, the load path brackets can be arranged such that a longitudinal axis of a portion of load path bracket is positioned based on a predetermined force direction of a predetermined impact force.

15 Claims, 4 Drawing Sheets

(56) References Cited

U.S. PATENT DOCUMENTS 8,677,972 B2 3/2014 Kim et al.

* cited by examiner

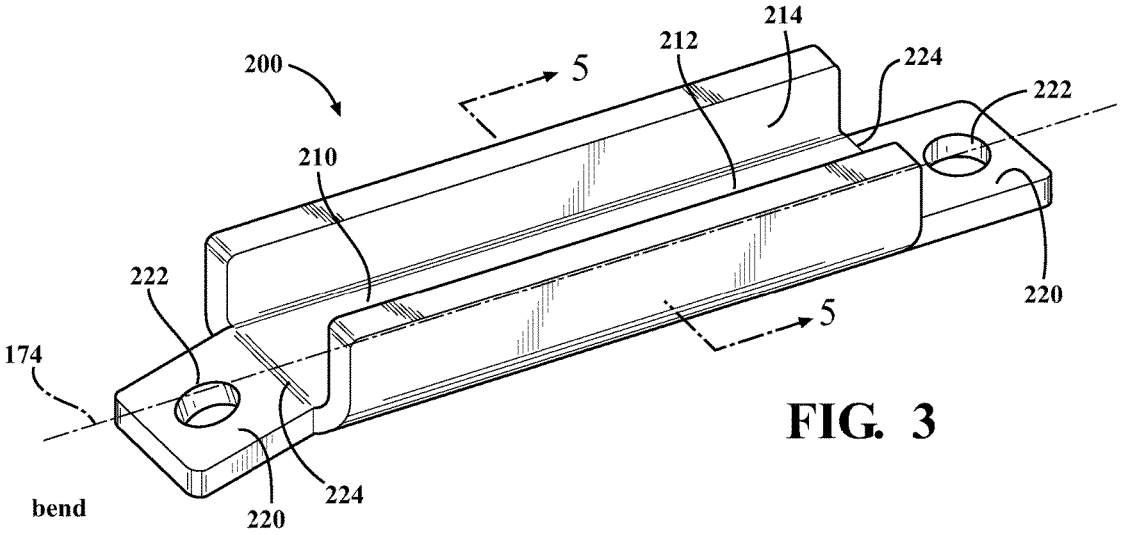
FIG. 3
FIG. 4
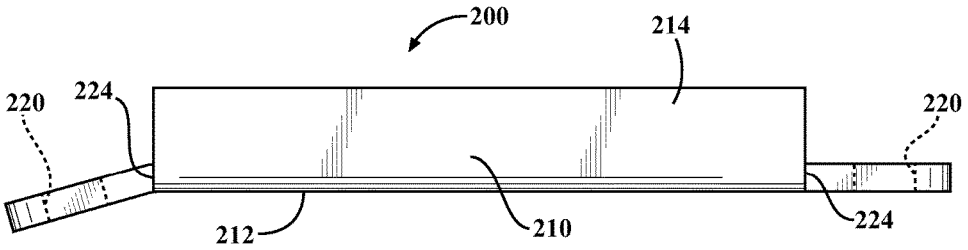
FIG. 5
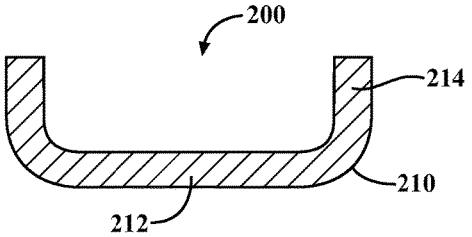

PROTECTION OF VEHICLE ENGINE INTAKE COMPONENTS

FIELD

The present disclosure relates in general to engine intake components for vehicles, and, more particularly, to the protection of air and fuel intake systems for vehicle engines.

BACKGROUND

Modern vehicles, such as passenger and commercial vehicles, have various components and systems within vehicle engine systems. Examples of such components and systems can include fuel and air intakes. Air intake systems may include a surge tank and a lower inlet manifold. The lower inlet manifold connects to a portion of an engine. Fuel intake systems can include fuel delivery components. An example of a fuel delivery component is a fuel rail that is installed near the top of one or more cylinder heads of the engine system.

The intake system components can be subjected to various forces resulting from collisions, accidents, or impacts to the area of the vehicle near the engine system. For example, the surge tank may contact a dash panel during a frontal vehicle collision. Under certain impact conditions, portions of the surge tank or lower inlet manifold may fracture, break, crack, or otherwise fail. Such failure can cause damage to other engine systems or components such as an engine fuel delivery component.

SUMMARY

In one respect, the present disclosure is directed to a vehicle engine system. The engine system can include a cylinder bank having a cylinder head and a cylinder head cover. The engine system can further include an air intake system having a lower intake manifold and a surge tank. The lower intake manifold can be operatively connected to the cylinder head, and the surge tank can be operatively connected to the lower intake manifold. A load path bracket can structurally connect the surge tank and the cylinder bank.

In another respect, the present disclosure is directed to a vehicle engine system having a cylinder bank including a cylinder head and a cylinder head cover. The engine system can further include an air intake system having a lower intake manifold connected to the cylinder head and a surge tank connected to the lower intake manifold. The system can further include an engine component extending between the cylinder bank and the air intake system. A load path bracket can be included that extends above the engine component and structurally connects the surge tank and the cylinder bank. The load path bracket can include a first end operatively connected to the surge tank, a second end operatively connected to the cylinder head cover, and a middle portion extending between the first and second ends.

In yet another respect, the present disclosure is directed to a method for providing a load path bracket within an engine system. The engine system can include a surge tank and a cylinder head. The method can include structurally connecting the surge tank and a cylinder head cover using a load path bracket. The load path bracket can be oriented with respect to a predetermined impact force direction.

Variations in these and other aspects, features, elements, implementations, and embodiments of the methods, systems, and apparatuses are disclosed herein are described in further detail hereafter.

BRIEF DESCRIPTION OF THE DRAWINGS

FIG. 3 is a view of an exemplary load path bracket.

FIG. 4 is a side view of the load path bracket of FIG. 3.

FIG. 5 is a cross-sectional view of the load path bracket, viewed along line 5-5 of FIG. 3.

DETAILED DESCRIPTION

Figure 1:
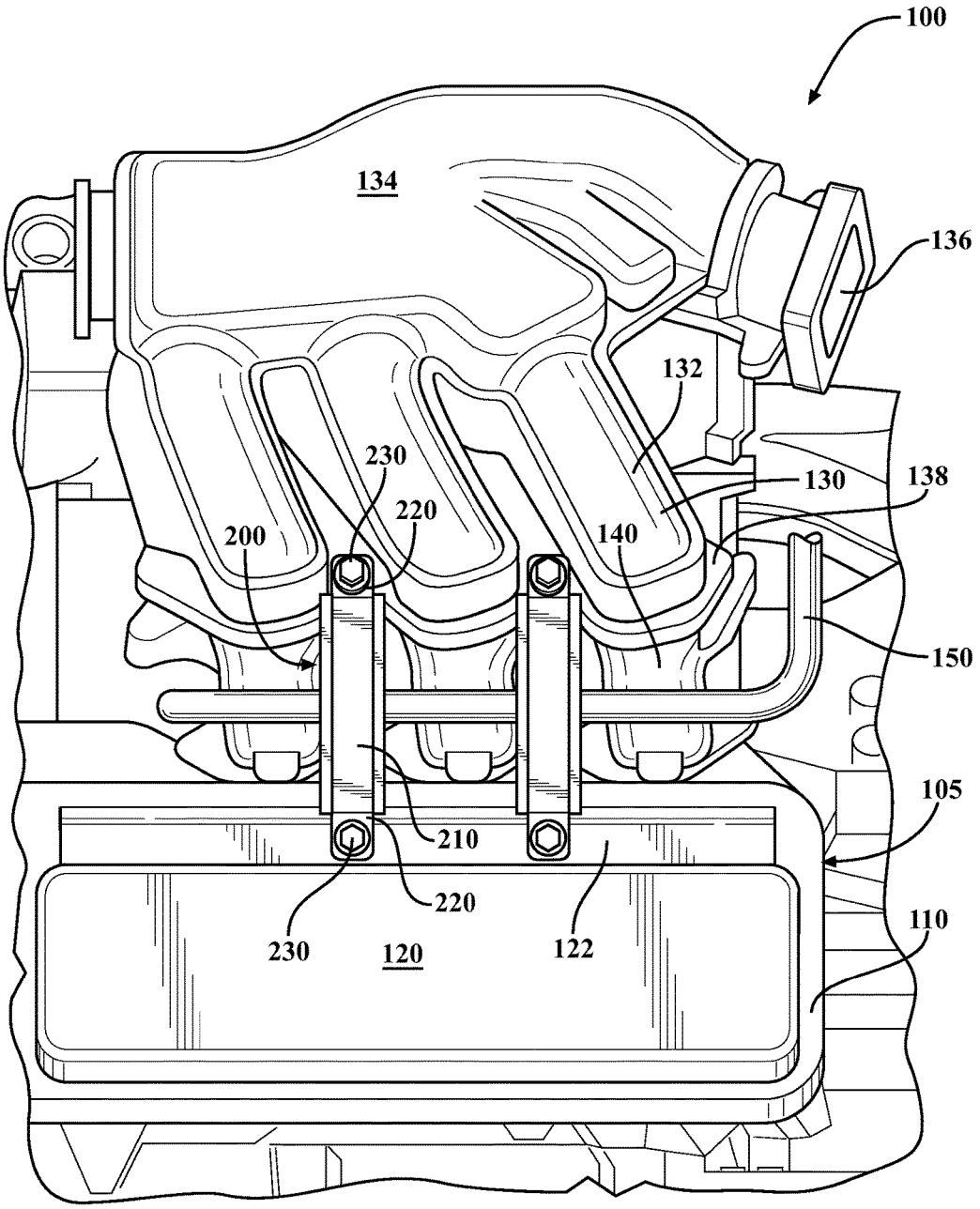
FIG. 1 is a view of an example of a vehicle engine system.

Arrangements described herein relate to the protection of components within vehicle engine systems. In one or more arrangements, a vehicle engine system may include an air intake system, a fuel delivery or intake system, one or more cylinder banks, and one or more load path brackets. The intake system can include a surge tank and a lower inlet manifold. The fuel delivery system can include a fuel rail positioned in close proximity to the lower inlet manifold and/or cylinder banks. Load path brackets may be included in the engine system such that one end of the bracket is connected to a portion of the air intake system while an opposing end of the bracket is connected to a portion of a cylinder bank. In at least some instances, the load path bracket can reduce or prevent failure to engine system components such as the lower inlet manifold and surge tank in the event of external force application to the engine system.

Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in the Figures, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Figure 2:
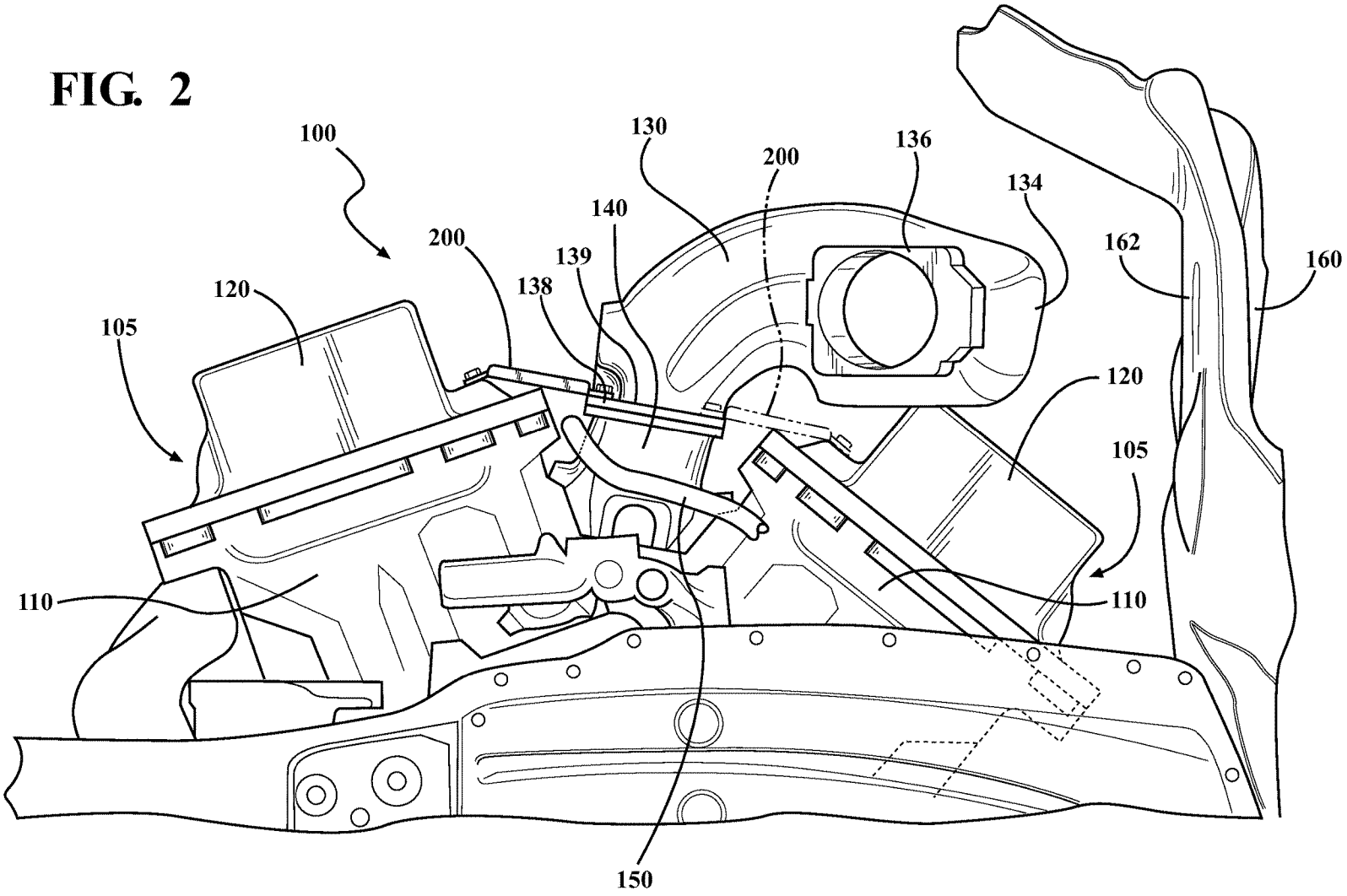
FIG. 2 is a side view of the example vehicle engine system of FIG. 1.

The general environment in which the one or more load path brackets can be used will now be described. Referring to FIGS. 1-2, an example of an engine system 100 is shown. Some of the various possible elements of the engine system 100 shown in the Figures will now be described. It will be understood that it is not necessary for the engine system 100 to have all of the elements shown in the Figures or described herein. The engine system 100 can have any combination of the various elements shown in the Figures. In one or more arrangements, the engine system 100 can include one or more elements in addition to one or more of the various elements shown in FIGS. 1-2. The term "engine" or "engine system" can be used interchangeably and can include any system or apparatus capable of converting energy into useful mechanical motion to power a vehicle. For instance, the engine system 100 can include internal combustion engines, fuel cells, or electric motors. As described with greater detail below, the engine system 100 can include a transverse mounted V6 internal combustion engine. The engine system 100 can be any engine system, now known or later developed.

As shown, the engine system 100 can generally include an air intake system, a fuel intake system, one or more cylinder banks, and one or more load path brackets. In one or more arrangements, the engine system 100 can be located in any suitable location within a vehicle, such as in an engine bay in a front portion of the vehicle. As used herein, "vehicle" means any form of motorized transport. In one or more implementations, the vehicle can be an automobile. While arrangements will be described herein with respect to automobiles, it will be understood that embodiments are not limited to automobiles. In some implementations, the vehicle can be a watercraft, an aircraft or any other form of motorized transport.

In one or more vehicular applications, a cylinder bank 105 can include one or more combustion chambers configured to allow combustion of a fuel to generate mechanical and/or electrical energy. For example, the engine system 100 can include an internal combustion engine, and the cylinder bank 105 can define multiple combustion cylinders. The cylinder bank 105 may be oriented in a variety of ways within an engine compartment of a vehicle. As described herein and as shown in the Figures, for example, a plurality of cylinder banks 105 can be transverse-mounted within the vehicle (that is, the cylinder banks can be orientated transversely with respect to a longitudinal axis of the vehicle).

In one or more arrangements, the cylinder bank 105 can include a cylinder head 110 and a cylinder head cover 120. The cylinder head 110 can have any suitable configuration based on the particular application. In one or more arrangements, the engine system 100 can include two cylinder banks 105 and thus two cylinder heads 110. The cylinder head 10 can be operatively connected to a portion of an engine block (not shown). As used herein, the term "operatively connected" can include direct and indirect connections, including connections without direct physical contact. In some arrangements of engine system 100, the cylinder head 110 and the engine block can be a unitary physical structure, that is, a structure formed from a single piece of material (e.g. by casting, machining, three dimensional printing, etc.). The cylinder head 110 together with the engine block may at least partially form the one or more combustion chambers. For example, the cylinder head 110 and the engine block may define three combustion cylinders. A second cylinder head 110 attached to the engine block may define an additional three combustion cylinders of a V-6 engine. Air, fuel, or a mixture of both can be introduced to the combustion cylinders and be converted to mechanical energy to power the vehicle. The cylinder head 110 can include additional components for engine system 100, such as valves, spark plugs, and fuel injectors. The cylinder head 110 can be operatively connected to an engine block with the connection being sealed by a head gasket.

In some embodiments, the cylinder bank 105 can include cylinder head cover 120 that is operatively connected to cylinder head 110. For instance, the cylinder head cover 120 may connect to and cover a portion of the cylinder head 110 opposite the engine block. The cylinder head cover 120 can have any suitable configuration. For instance, the cylinder head cover 120 can be shaped, arranged, oriented, positioned, and/or connected within a vehicle in any suitable manner, such as, for example, based on any combination of safety, design, space, and/or material considerations or constraints. The cylinder head cover 120 can include two sets of opposing sides, and a top extending to each of the four sides. The cylinder head cover 120 can provide access to the cylinder head 110 and/or components retained or associated with the cylinder head 110 when the cylinder head cover 120 is removed. Additionally, the cylinder head cover 120 can be beneficial in one or more other respects, such as in the reduction of noise vibration harshness (NVH), weight, and material or manufacturing cost characteristics of the engine system 100, just to name a few possibilities.

In one or more arrangements, the air intake system can generally include a surge tank 130 and a lower inlet manifold 140. The surge tank 130 can be operatively connected to the lower inlet manifold 140 such that one or more interior channels or cavities of the surge tank 130 and the lower inlet manifold 140 are in fluid communication with each other. Thus, the air intake system can allow for air outside of the engine system 100 to be moved into and through the surge tank 130 and into and through the lower inlet manifold 140. The air can be introduced to specific components of engine system 100, such as the combustion chambers. As used herein, the term "air" may include any mixture of fluid. Thus, air can include environmental gas from outside engine system 100. Additionally, air may include a mix of environmental gas, exhaust gas from engine system 100, and/or any other gas or liquid additives.

The surge tank 130 can have any suitable configuration. For example, the surge tank 130 can, in one or more arrangements, define outlet tubes 132, a main portion 134, and an inlet 136. Air can be introduced into surge tank 130 via inlet 136. The inlet 136 may be operatively connected to additional air intake system components, such as a throttle body (not shown). Air can transfer through one or more additional components upstream of the inlet 136. For example, air exterior to a vehicle or within an engine compartment may be introduced through an air filter, an intake tube, and a throttle body upstream of the inlet 136. The inlet 136 can generally be an aperture defined in the main portion 134 of the surge tank 130. For instance, the inlet 136 can be a circular aperture as shown in FIG. 2. Other arrangements of inlet 136 can be configured in any suitable shape, such as rectangular, oval, triangular, etc.

The main portion 134 of surge tank 130 can define an internal chamber within the surge tank 130 in which air can accumulate from inlet 136. Air may collect within the chamber of the main portion 134 prior to moving to other components of engine system 100.

In one or more arrangements, the outlet tubes 132 can extend from the main portion 134. The outlet tubes 132 may define channels or tubes in fluid communication with the cavity defined by the main portion 134. The surge tank 130 can be configured to have any number of outlet tubes 132, based upon application. The outlet tubes 132 can extend to an attachment flange 138. As described in more detail below, the attachment flange 138 of the surge tank 130 can be operatively connected to the lower inlet manifold 140.

The surge tank 130, including the outlet tubes 132, the main portion 134, and the inlet 136, can have any suitable size, shape, and/or configuration. The surge tank 130 can be positioned and/or operatively connected within the engine system 100 in any suitable manner. For instance, the surge tank 130 can be shaped, sized, configured, positioned, and/or operatively connected within the engine system 100 based on one or more factors, including, for example, safety, design, space, airflow requirements, and/or material considerations or constraints.

The surge tank 130 can be made of any suitable material. For instance, the surge tank 130 can be made of one or more polymers or metals. In one or more arrangements, the surge tank 130 can have a substantially uniform thickness. In one or more arrangements, the surge tank 130 can have non-uniform thickness. For instance, the surge tank 130 can have increased thickness at attachment flange 138 and/or inlet 136. Additionally, the surge tank 130 can have any suitable cross-sectional shape. For instance, the inlet 136, the main portion 134, and the outlet tubes 132 can have varying cross-sectional shape along portions of the surge tank 130.

In one or more arrangements, the lower inlet manifold 140 can be operatively connected to the surge tank 130. The lower inlet manifold 140 can also be operatively connected to the cylinder head 110. For instance, the lower inlet manifold 140 can be positioned and configured to allow air to flow from the surge tank 130 to the one or more combustion chambers of the engine system 100.

The lower inlet manifold 140 can have any suitable size, shape, and/or configuration. The lower inlet manifold 140 can be positioned and/or operatively connected within the engine system 100 in any suitable manner. For instance, the lower inlet manifold 140 can be shaped, sized, configured, positioned, and/or operatively connected within the engine system 100 based on one or more factors, including, for example, safety, design, space, airflow requirements and/or material considerations or constraints.

The lower inlet manifold 140 can be made of any suitable material. For instance, the lower inlet manifold 140 can be made of one or more metals, such as aluminum. In one or more arrangements, the lower inlet manifold 140 can have a substantially uniform thickness. In one or more arrangements, the lower inlet manifold 140 can have non-uniform thickness. For instance, the lower inlet manifold 140 can have increased thickness at or near the areas in which it is operatively connected to another component or structure. Additionally, the lower inlet manifold 140 can have any suitable cross-sectional shape.

The operative connection between the surge tank 130 and the lower inlet manifold 140 can be achieved in a variety of ways. For example, each of the surge tank 130 and the lower inlet manifold 140 can include a contact surface, wherein each of the contact surfaces is configured and positioned to abut or contact the other. In one or more arrangements, a seal or gasket may be positioned between the surge tank 130 and the lower inlet manifold 140. Furthermore, in some embodiments, portions of the surge tank 130 may extend into apertures defined in the lower inlet manifold 140. As previously mentioned, the attachment flange 138 of the surge tank 130 may be operatively connected to a top portion of the lower inlet manifold 140. In some instances, one or more fasteners 230 may be used to operatively connect the surge tank 130 and lower inlet manifold 140. For example, the fastener 230 can extend through apertures defined in attachment flange 138 of the surge tank 130 and a top portion of the lower inlet manifold. The fasteners 230 can include bolts, screws, pins, and/or clips, just to name a few examples.

In one or more arrangements, the fuel intake system of engine system 100 can include a fuel line or fuel rail 150 to deliver fuel to one or more other components of the engine system 100. The term "fuel" can include any energy source useable by engine system 100. For example, fuel can include gasoline, oil, biofuel, hydrogen, ethanol, or any combination thereof. As used herein, the terms "fuel line" and "fuel rail" can be used interchangeably and include any physical structure that allows the passage of fluid there through.

The fuel rail 150 can have any suitable configuration within engine system 100. The fuel rail 150 can be positioned and/or operatively connected within the engine system 100 in any suitable manner. For instance, the fuel rail 150 can be shaped, sized, configured, positioned, and/or operatively connected within the engine system 100 based on one or more factors, including, for example, safety, design, space, fuel flow requirements and/or material considerations or constraints. In one or more arrangements, the fuel rail 150 may be configured to deliver fuel to cylinder heads 110. For instance, the fuel rail 150 can have central portion configured to convey fuel to one or more fuel outlets (not shown). For example, the fuel rail 150 may have a number of fuel outlets matching the number of combustion chambers within a vehicle engine.

In some embodiments, the fuel rail 150 is operatively connected within the engine system 100 such that a portion of the fuel rail 150 extends proximate to at least one cylinder bank 105. For example, the fuel rail 150 can have a longitudinal axis extending near one side of a cylinder bank 105. In one or more arrangements, the fuel rail 150 may extend between cylinder head 110 and lower inlet manifold 140 as generally shown in the Figures. The fuel rail 150 can be positioned near the lower inlet manifold 140. In such position, the fuel rail 150 can be subjected to impacts or forces if portions of the surge tank 130 or the lower inlet manifold 140 fracture, move, or break off during impacts.

With reference to FIG. 2, the engine system 100 can be located near a dash panel 160. The dash panel 160 can partially define a rearward limit to an engine compartment or engine bay of a vehicle. The dash panel 160 can be shaped, positioned, and/or connected within a vehicle in any suitable manner, such as, for example, based on any combination of safety, design, space, and/or material considerations or constraints. In some embodiments, the dash panel 160 can include a dash surface 162 that generally faces engine system 100. As further discussed below, during a vehicle crash or impact, portions of engine system 100 may contact the dash surface 162 of the dash panel 160. In one or more arrangements, dash panel 160 can include a portion that extends substantially vertical, or otherwise with a substantially upright orientation.

In one or more arrangements, the engine system 100 can include one or more load path brackets 200. As used herein, the term "load path bracket" can mean any physical structure that can absorb, transfer, resist, re-direct, and/or dampen an applied force. The load path brackets 200 can protect, strengthen, and/or support one or more portions of the engine system 100. For instance, as described below, the load path brackets 200 can help to protect the surge tank 130 and/or lower inlet manifold 140 during impacts to the engine system 100. The load path brackets 200 can be operatively connected within the engine system 100 to structurally connect two or more components therein. As used herein, "structurally connect" can include any arrangements that allow for forces, impacts, and/or vibrations to be transferred between physical components. Components may be structurally connected through direct and indirect attachments or connections. For instance, the load path brackets 200 can be operatively connected to the surge tank 130 and/or lower inlet manifold 140 at or near a first end. The load path brackets 200 can be operatively connected to the cylinder head 110 and/or the cylinder head cover 120 at or near a second end. In the non-limiting examples shown in FIGS. 1 and 2, the load path brackets 200 can structurally connect at least the surge tank 130 and the cylinder head cover 120.

The load path brackets 200 can have any suitable configuration. FIGS. 3-5 are views of exemplary embodiments of a load path bracket 200. As shown, the load path bracket 200 can generally include a middle portion 210 and two end portions 220. The end portions 220 can be configured to be operatively connected to components within the engine system 100. For instance, each of the end portions 220 can include one or more attachment features. In one or more arrangements, the attachment features can include apertures 222 defined in the end portions 220. While apertures 222 are shown, additional or alternative attachment features can be included with load path bracket 200, such as grooves, slots, adhesives, pins, fasteners, connectors, adhesives, and/or other manners of mechanical and/or chemical fastening, for example. While embodiments are shown having two end portions 220, the load path brackets 200 can have any suitable shape and/or configuration. For instance, the load path bracket 200 can have more than two end portions 220.

The middle portion 210 can have any suitable size, shape, and/or configuration. In one or more arrangements, the middle portion 210 can extend substantially straight between the end portions 220. In such instances, the middle portion 210 can define a longitudinal axis 174. In one or more other arrangements, the middle portion 210 can include one or more non-straight features along at least a portion of its length. For instance, the middle portion 210 can include one or more bends, curves, steps or folds.

In one or more arrangements, the middle portion 210 is a substantially flat or substantially planar structure. Additionally, the middle portion 210 can have one or more non-flat or non-planar features. The middle portion 210 can include a substantially flat center 212 and one or more side walls 214 as shown in the Figures. In one or more arrangements, side walls 214 can extend away from the center 212 at a substantially perpendicular angle. Thus, the middle portion 210 of the load path bracket 200 can have a substantially "U" shaped cross-section, as shown in FIG. 5. In one or more arrangements, the side walls 214 can be substantially parallel to each other.

It will be understood that the load path bracket 200 shown in FIGS. 3-5 is provided merely as an example. Indeed, the load path bracket 200 can have various suitable shapes, sizes, and/or configurations. Additionally, the middle portion 210 or at least a portion thereof can be solid or hollow. In one or more arrangements, the middle portion 210 can be tubular, with round or rectangular cross-sectional shapes.

In one or more arrangements, the end portions 220 of the load path bracket 200 can be shaped and configured in any suitable manner to facilitate its operative connection within engine system 100. For example, the end portions 220 can include a substantially planar tab portion. The end portion 220 can include aperture 222 defined within the tab portion. In one or more arrangements, the end portions 220 can have different configurations than the middle portion 210. For instance, the size, shape, orientation, or thickness of the end portions 220 can differ from the middle portion 210. In the example shown in FIGS. 3-5, the end portions 220 can be shaped substantially flat, not having side walls. In some embodiments, at least one of the end portions 220 can be bent or angled relative to each other and/or the middle portion 210. For example, one of the end portions 220 can be bent downward from the middle portion 210 as shown in FIGS. 3 and 4. Any suitable angle can be provided between the end portions 220 and the middle portion 210. In one or more arrangements, there can be an obtuse angle formed between at least one of the end portions 220 and the middle portion 210.

The load path bracket 200 can be made of any suitable material. For instance, the load path bracket 200 can be made of one or more polymers or metals, such as steel. In one or more arrangements, the load path bracket 200 can have a substantially uniform thickness. In one or more arrangements, the load path bracket 200 can have non-uniform thickness. For instance, the load path bracket 200 can have increased thickness at the middle portion 210 as compared to the end portions 220.

The load path bracket 200 can be operatively connected within engine system 100 in any suitable way. In some arrangements, a first end of the load path bracket 200 can be operatively connected to the surge tank 130. For instance, the end portion 220 can extend past an edge of the attachment flange 138 such that the end portion 220 overlaps a mounting surface 139 of the attachment flange 138. The end portion 220 can extend substantially parallel to the top surface of the attachment flange 138. The end portion 220 can substantially matingly engage the top surface of the attachment flange 138. In one or more arrangements, the aperture 222 in the end portion 220 can be substantially axially aligned with apertures (not shown) defined in the surge tank 130 and/or the lower inlet manifold 140. In some arrangements, the surge tank 130, the lower inlet manifold 140, and the load path bracket 200 can be operatively connected by a fastener 230.

In some arrangements, a second end of the load path bracket 200 can be operatively attached to the cylinder head cover 120. For instance, the end portion 220 can extend past an edge of the cylinder head cover 120 such that the end portion 220 overlaps a cover mounting surface 122 of the cylinder head cover 120. The end portion 220 can extend substantially parallel the cover mounting surface 122. The end portion 220 can substantially matingly engage the cover mounting surface 122. In one or more arrangements, the aperture 222 in the end portion 220 can be substantially axially aligned with apertures (not shown) defined in the cylinder head cover 120. T the load path bracket 200 can be operatively connected to the cylinder head cover 120 by the fastener 230.

A load path bracket 200 can be oriented within an engine system 100 in any suitable manner, including the orientations described herein. For instance, the load path bracket 200 can be positioned between, and structurally connect, an air intake system and a cylinder bank 105 as shown in the Figures. In some embodiments, the load path bracket 200 can be operatively connected at a first end to the surge tank 130. The second end of the load path bracket 200 can be operatively connected to the cylinder head cover 120. For instance, the load path bracket 200 can extend between the surge tank 130 and the cylinder head cover 120 above the fuel rail 150.

In one or more arrangements, the end portion 220 that is operatively connected to the cylinder head cover 120 can be positioned at a higher elevation than the end portion 220 operatively connected to the surge tank 130 (see FIG. 2, for example). In one or more arrangements in which a plurality of load path brackets 200 are used, the load path brackets 200 may be operatively positioned within the engine system 100 so as to be substantially parallel to one another. In one or more other arrangements, the load path brackets 200 arranged in non-parallel orientations. For example, the end portions 220 can be located closer or farther apart from each other at one end of the load path brackets 200 than at the opposing end.

In one or more arrangements in which a plurality of load path brackets 200 are used, the load path brackets 200 can be substantially identical to each other at least with respect to their size, shape, and/or configuration. In one or more arrangements, at least one of the load path brackets 200 can be different from the other load path brackets 200 in one or more respects, such as size, shape, and/or configuration. The load path brackets 200 can be fixed in size, shape, and/or configuration. Alternatively, the load path brackets 200 can allow for the size, shape, and/or configuration to be adjustable. For example, the length of the load path brackets 200 can be adjustable.

In addition, one or more arrangements of engine system 100 can include load path brackets 200 oriented based on impact considerations. For instance, the movement of the engine system 100 can be determined for one or more predetermined impact conditions. "Predetermined impact condition" can mean that a vehicle impacts or collides with another physical object with one or more predetermined characteristics. Examples of the predetermined impact condition can include a frontal vehicle impact, such as a frontal or overlap crash situation.

Figure 6:
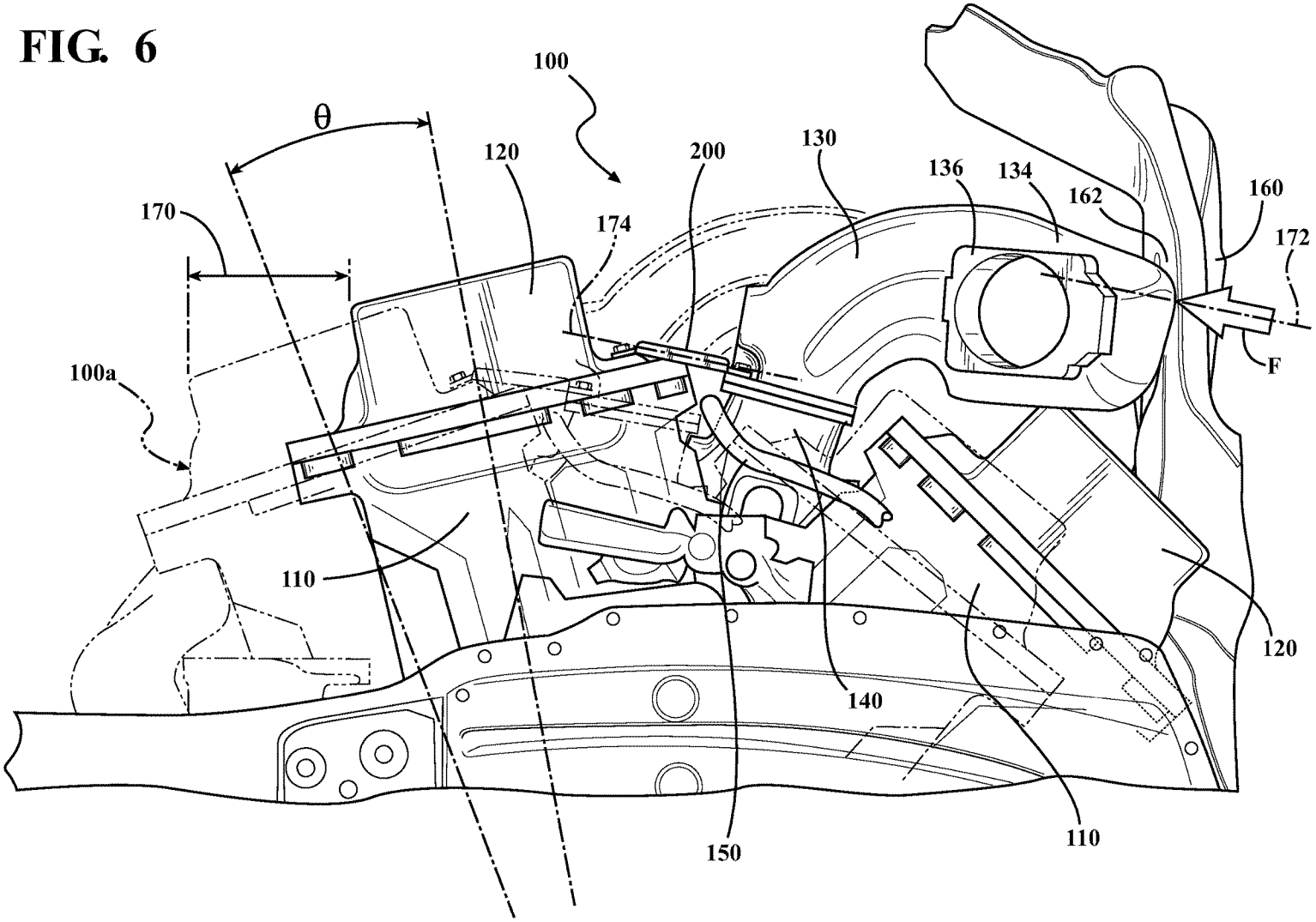
FIG. 6 is a view of an example vehicle engine system subjected to an impact force.

Responsive to the predetermined impact condition, the engine system 100 can move a distance in one or more directions. As an example, in one predetermined impact condition, the engine system 100 can move approximately a distance 170 translationally, as shown in FIG. 6. Alternatively or in addition, the engine system 100 can rotate approximately an angle Θ during the predetermined impact condition. The predetermined impact condition can result in one or more forces being applied to components of the engine system 100. For instance, a force F can be applied to the engine system 100 as a result of contact between the engine system 100 and the dash panel 160. In some arrangements, the force F can be applied to the surge tank 130 of the engine system 100, resulting from the impact of the surge tank 130 and the dash panel 160.

The force F can be estimated, approximated, and/or determined based on the predetermined impact condition. The estimation, approximation, and/or determination of the force F can be performed in any suitable manner, using any suitable technique now known or later developed. Based on force F, an impact force direction 172 of the force F can also be estimated, approximated, and/or determined. "Impact force direction" can include the direction of the force F acting upon the surge tank 130 resulting from the contact between the surge tank 130 and the dash panel 160.

In one or more arrangements, the load path bracket 200 can be positioned or arranged based upon the predetermined impact force direction 172. For instance, the load path bracket 200 can be oriented such that the longitudinal axis 174 of the middle portion 210 would be substantially parallel to the predetermined impact force direction 172 during the predetermined impact condition. As used throughout this description, the term "substantially" includes exactly the term it modifies and slight variations therefrom. Thus, the term "substantially parallel" means exactly parallel and slight variations therefrom, such as within about +/−10 degrees for example. The load path bracket 200 can be positioned such that, upon relative movement of the engine system 100 by the distance 170 and the angle Θ, the longitudinal axis 174 will be substantially parallel to the predetermined impact force direction 172 as shown in FIG. 6.

In one or more arrangements, substantially parallel to the predetermined impact force direction 172 can define an upper limit for the orientation of the load path bracket 200. For instance, the load path bracket 200 can be operatively connected within engine system 100 such that upon the impact between the surge tank 130 and dash panel 160, the longitudinal axis is no more upright or vertical than the predetermined impact force direction 172. For example, the longitudinal axis 174 of the load path bracket 200 can be between a horizontal position and an angle substantially parallel to the predetermined impact force direction 172 during impact between the surge tank 130 and the dash panel 160.

In some arrangements, two or more load path brackets 200 can be included within engine system 100. In some embodiments, the longitudinal axes 174 of two or more load path brackets 200 may define a plane. The plane can extend substantially parallel to the predetermined impact force direction 172. However, each individual longitudinal axis 174 of the middle portions 210 of the load path brackets 200 may or may not be arranged to extend parallel to the predetermined force direction 172.

In one or more arrangements, the load path brackets 200 can structurally connect the surge tank 130 to the cylinder head cover 120 that is located at a position away from the dash panel 160. For example, the load path brackets 200 may be operatively connected to the cylinder head cover 120 of a forward cylinder bank 105 in a transverse-mounted engine. Such positioning can put the load path brackets 200 under a compressive force if forces are transferred from the dash panel 160 to the surge tank 130 to the forward cylinder head cover 120. In some embodiments, one or more load path brackets 200 can structurally connect the surge tank 130 to a rear/aft cylinder bank 105 instead of, or in addition to, the load path brackets 200 positioned between the surge tank 130 and the forward cylinder bank 105. For example, the engine system 100 can include a rear load path bracket 200 (shown with phantom lines in FIG. 2). A rear load path bracket 200 can be subject to tensile forces during the predetermined impact condition.

In one or more arrangements, the one or more load path brackets 200 can be positioned and operatively connected within engine system 100 through a variety of methods. For instance, the one or more load path brackets 200 can be brought together with the surge tank 130 and the cylinder head cover 120. The load path brackets 200 can bridge the gap between the surge tank 130 and the cylinder head cover 120. The load path brackets 200 can extend above the fuel rail 150. As used herein, the term "bringing together" or "brought together" means any movement, positioning and/or manipulation of one or more components, including one or more components of the engine system and/or one or more of the load path brackets. The load path brackets 200 can be operatively connected to one or more components of the engine system 100 in any suitable manner. For instance, the load path brackets 200 can be operatively connected by one or more fasteners and/or one or more forms of mechanical engagement. Alternatively or in addition, the load path brackets 200 can be operatively connected by other methods, such as the use of adhesives, welding and/or brazing.

In some embodiments, the load path brackets 200 are brought together with the surge tank 130 such that the load path bracket is operatively connected to the surge tank 130 using fasteners 230. The fasteners 230 can also operatively connect the surge tank 130 with the lower inlet manifold 140. By using common fasteners 230, the load path brackets 200 can reinforce or transfer forces at the areas of the surge tank 130 and lower inlet manifold 140 near the fastener 230.

In one or more arrangements, methods for positioning the load path brackets 200 can include bringing together the load path brackets 200 with engine components with particular orientations of the load path brackets 200 in mind. For instance, the position and orientation of the engine system 100 during a predetermined impact condition can be predetermined. For example, physical or computer-aided simulation or testing can determine the approximate movement and position of the engine system 100 as it contacts the dash panel 160. In one or more arrangements, the engine system 100 can be estimated to move a distance 170 and/or rotated an angle Θ during the predetermined impact condition from an original position. Such a condition is shown in FIG. 6, the movement of the engine system 100 being shown in phantom lines as 100*a*. Furthermore, the impact force F and the force direction 172 can be predetermined based on the predetermined impact condition. As described above, in some arrangements, the load path brackets 200 can be arranged in particular orientations based on the predetermined impact condition and predetermined impact force direction 172. For example, the load path brackets 200 can be brought together within the engine system 100 such that the longitudinal axis 174 of the load path bracket 200 extends substantially parallel to the predetermined impact force direction 172.

Methods can include other steps that are not shown here, and in fact, methods are not limited to including every step described. Furthermore, the steps detailed here as part of the method for providing a protector are not limited to this particular chronological order. Indeed, some of the steps can be performed in a different order than what is described and/or at least some of the steps can occur simultaneously.

It will be appreciated that arrangements described herein can provide numerous benefits, including one or more of the benefits mentioned herein. For example, arrangements described herein can increase the strength and/or rigidity of portions of an engine system. The load path brackets can absorb or transfer forces during impacts to the engine system. For example, when an engine system is rotated and moved rearward during a collision, a surge tank may impact a dash panel. Rather than the force arising from the impact between the surge tank and the dash panel being transferred into a lower inlet manifold, the force may be at least partially transferred to other engine components via the load path brackets. Estimations or determinations of the engine system position and movement can be determined to appropriately position the load path brackets. For example, the load path brackets can be oriented substantially parallel to an application of force upon the surge tank impacting the dash panel. Furthermore, the load path brackets can provide other benefits, such as improved NVH characteristics.

As used herein, the terminology "example", "embodiment", "implementation", "aspect". "feature", or "element" indicate serving as an example, instance, or illustration. Unless expressly indicated, any example, embodiment, implementation, aspect, feature, or element is independent of each other example, embodiment, implementation, aspect, feature, or element and can be used in combination with any other example, embodiment, implementation, aspect, feature, or element.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B, or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein can include sequences or series of steps or stages, elements of the methods disclosed herein can occur in various orders or concurrently. Additionally, elements of the methods disclosed herein can occur with other elements not explicitly presented and described herein. Furthermore, not all elements of the methods described herein can be required to implement a method in accordance with this disclosure. Although aspects, features, and elements are described herein in particular combinations, each aspect, feature, or element can be used independently or in various combinations with or without other aspects, features, and elements.

Although features can be described above or claimed as acting in certain combinations, one or more features of a combination can in some cases be excised from the combination, and the combination can be directed to a sub-combination or variation of a sub-combination.

The above-described aspects, examples, and implementations have been described in order to allow easy understanding of the application are not limiting. On the contrary, the application covers various modifications and equivalent arrangements included within the scope of the appended claims, which scope is to be accorded the broadest interpretation so as to encompass all such modifications and equivalent structure as is permitted under the law.

What is claimed is:

1. A vehicle engine system, comprising:
   - a cylinder bank including a cylinder head and a cylinder head cover;
   - an air intake system including a lower intake manifold and a surge tank, the lower intake manifold being operatively connected to the cylinder head, and the surge tank being operatively connected to the lower intake manifold; and
   - a load path bracket structurally connecting the surge tank and the cylinder bank,
   - wherein a first end of the load path bracket is operatively connected to the surge tank, and wherein a second end of the load path bracket is operatively connected to the cylinder head cover.

2. The system of claim 1, wherein the second end is positioned at a higher elevation than the first end.

3. The system of claim 2, wherein the first end is operatively connected to the surge tank by one or more fasteners.

4. The system of claim 3, wherein the second end is operatively connected to the cylinder head cover by one or more fasteners.

5. The system of claim 1, further including a fuel rail that extends between the cylinder bank and the air intake system, and wherein the load path bracket extends above the fuel rail.

6. A vehicle engine system, comprising:
   - a cylinder bank including a cylinder head and a cylinder head cover;
   - an air intake system including a lower intake manifold and a surge tank, the lower intake manifold being operatively connected to the cylinder head, and the surge tank being operatively connected to the lower intake manifold; and a load path bracket structurally connecting the surge tank and the cylinder bank, wherein the load path bracket further includes a middle portion that extends between a first end and a second end, wherein the middle portion extends substantially straight and defines a longitudinal axis, and wherein the longitudinal axis of the middle portion extends substantially parallel to a predetermined impact force direction during a predetermined impact condition.

7. The system of claim 6, wherein the load path bracket is a first load path bracket, and further including:

a second load path bracket structurally connecting the surge tank and the cylinder bank, wherein a first end of the second load path bracket is operatively connected to the surge tank, and wherein a second end of the second load path bracket is operatively connected to the cylinder head cover, wherein the second load path bracket further includes a middle portion that extends between the first and second ends, and wherein the middle portion extends substantially straight and defines a longitudinal axis, wherein the longitudinal axis of the first load path bracket and the longitudinal axis of the second load path bracket define a plane, and wherein the plane extends substantially parallel to a predetermined impact force direction during a predetermined impact condition.

8. The system of claim 7, wherein the longitudinal axis of the first load path bracket is substantially parallel to the longitudinal axis of the second load path bracket.

9. The system of claim 7, wherein the longitudinal axis of the first load path bracket is substantially non-parallel to the longitudinal axis of the second load path bracket.

10. A vehicle engine system, comprising:

a cylinder bank including a cylinder head and a cylinder head cover;

an air intake system including a lower intake manifold and a surge tank, the lower intake manifold being operatively connected to the cylinder head, and the surge tank being operatively connected to the lower intake manifold;

an engine component extending between the cylinder bank and the air intake system; and a load path bracket extending above the engine component and structurally connecting the surge tank and the cylinder bank, the load path bracket including a first end operatively connected to the surge tank, a second end operatively connected to the cylinder head cover, and a middle portion extending between the first and second ends, wherein the middle portion has a substantially U-shaped cross-sectional shape.

11. The system of claim 10, wherein the first end is oriented at an angle relative to at least one of the second end and the middle portion.

12. The system of claim 10, wherein the first end is shaped to substantially matingly engage a contour of a portion of the surge tank and the second end is shaped to substantially matingly engage a contour of a portion of the cylinder head cover.

13. The system of claim 10, wherein the engine component is a fuel line.

14. A method for providing a load path bracket within an engine system, the engine system including a surge tank and a cylinder head, the method comprising:

predicting a translational and rotational movement of the engine system within a vehicle during a predetermined impact condition;

determining an impact force direction of a force applied to the surge tank, wherein determining the impact force direction of the force applied to the surge tank is performed via at least one of a computer-aided simulation and physical testing; and structurally connecting the surge tank and a cylinder head cover using a load path bracket, the load path bracket being oriented with respect to an impact force direction.

15. The method of claim 14, wherein the load path bracket is oriented such that a longitudinal axis of a portion of the load path bracket is substantially parallel to the determined impact force direction.

* * * * *